US011177573B2

(12) United States Patent
Ying

(10) Patent No.: US 11,177,573 B2
(45) Date of Patent: Nov. 16, 2021

(54) C-FED ANTENNA FORMED ON MULTI-LAYER PRINTED CIRCUIT BOARD EDGE

(71) Applicant: Sony Mobile Communications Inc., Tokyo (JP)

(72) Inventor: Zhinong Ying, Lund (SE)

(73) Assignee: Sony Group Corporation, Tokyo (JP)

( * ) Notice: Subject to any disclaimer, the term of this patent is extended or adjusted under 35 U.S.C. 154(b) by 175 days.

(21) Appl. No.: 16/099,979

(22) PCT Filed: May 10, 2016

(86) PCT No.: PCT/EP2016/060427
§ 371 (c)(1),
(2) Date: Nov. 8, 2018

(87) PCT Pub. No.: WO2017/194096
PCT Pub. Date: Nov. 16, 2017

(65) Prior Publication Data

US 2020/0313300 A1 Oct. 1, 2020

(51) Int. Cl.
*H01Q 9/04* (2006.01)
*H01Q 21/28* (2006.01)
(Continued)

(52) U.S. Cl.
CPC ..... *H01Q 9/0421* (2013.01); *H01Q 9/0457* (2013.01); *H01Q 9/285* (2013.01); *H01Q 21/28* (2013.01); *H01Q 21/30* (2013.01)

(58) Field of Classification Search
CPC .... H01Q 9/0407; H01Q 9/0421; H01Q 9/045; H01Q 9/0457; H01Q 9/065; H01Q 9/285; H01Q 21/28; H01Q 21/30; H01Q 1/38
See application file for complete search history.

(56) References Cited

U.S. PATENT DOCUMENTS 6,943,735 B1 9/2005 Cadotte
8,766,867 B2 * 7/2014 Ying ..... H01Q 1/521 343/833

(Continued)

OTHER PUBLICATIONS

International Search Report and Written Opinion from counterpart International Patent Application No. PCT/EP2016/060427, dated Jan. 25, 2017, 11 pages.

*Primary Examiner* — Andrea Lindgren Baltzell
*Assistant Examiner* — Patrick R Holecek
(74) *Attorney, Agent, or Firm* — Tucker Ellis LLP

(57) ABSTRACT

C-fed antenna formed on multi-layer printed circuit board edge A patch antenna (120) comprises an antenna patch (121) and a feeding patch (125) configured for capacitive feeding of the antenna patch (121). The antenna patch (121) is formed of multiple conductive strips (122) extending in a horizontal direction along an edge of a multi-layer printed circuit board (PCB). The multi-layer PCB has multiple layers stacked along a vertical direction. Each of the conductive strips (122) of the antenna patch (121) is arranged on a different layer of the multi-layer PCB. The conductive strips (122) are electrically connected to each other by conductive vias (123) extending between two or more of the conductive strips (122) of the antenna patch (121). The feeding patch (125) is formed of multiple conductive strips (126) extending in the horizontal direction. Each of the conductive strips (126) of the feeding patch (125) is arranged on a different layer of the multilayer PCB. The conductive strips (126) of the feeding patch are electrically connected to each other by conductive vias (127) extending between two or more of the conductive strips (126) of the feeding patch (125).

17 Claims, 5 Drawing Sheets

(51) Int. Cl.
*H01Q 21/30* (2006.01)
*H01Q 9/28* (2006.01)

(56) References Cited

U.S. PATENT DOCUMENTS

| | | | | |
|---|---|---|---|---|
| 8,779,564 | B1 | 7/2014 | Knudsen | |
| 9,666,954 | B2 * | 5/2017 | Ko | H01Q 19/32 |
| 10,461,401 | B2 * | 10/2019 | Ko | H01Q 1/48 |
| 2013/0207869 | A1 | 8/2013 | Han | |
| 2016/0087348 | A1 | 3/2016 | Ko | |

* cited by examiner

C-FED ANTENNA FORMED ON MULTI-LAYER PRINTED CIRCUIT BOARD EDGE

FIELD OF THE INVENTION

The present invention relates to antennas, antenna devices with one or more antennas and communication devices equipped with such antenna device.

BACKGROUND OF THE INVENTION

In wireless communication technologies, various frequency bands are utilized for conveying communication signals. In order to meet increasing bandwidth demands, also frequency bands in the millimeter wavelength range, corresponding to frequencies in the range of about 10 GHz to about 100 GHz, are considered. For example, frequency bands in the millimeter wavelength range are considered as candidates for 5G (5th Generation) cellular radio technologies. However, an issue which arises with the utilization of such high frequencies is that antenna sizes need to be sufficiently small to match the wavelength. Further, in order to achieve sufficient performance, multiple antennas (e.g., in the form of an antenna array) may be needed in small sized communication devices, such as mobile phones, smartphones, or similar communication devices.

Further, since losses on cables or other wired connections within the communication device typically increase towards higher frequencies, it may also be desirable to have an antenna design in which the antenna can be placed very close to radio front end circuitry.

Accordingly, there is a need for compact size antennas which can be efficiently integrated in a communication device.

SUMMARY OF THE INVENTION

According to an embodiment, an antenna is provided. The antenna comprises an antenna patch and a feeding patch configured for capacitive feeding of the antenna patch. The antenna patch is formed of multiple conductive strips extending in a horizontal direction along an edge of a multi-layer printed circuit board (PCB). The multi-layer PCB has multiple layers stacked along a vertical direction. Each of the conductive strips of the antenna patch is arranged on a different layer of the multi-layer PCB. The conductive strips are electrically connected to each other by conductive vias extending between two or more of the conductive strips of the antenna patch, which are arranged on different layers of the multi-layer PCB. The feeding patch is formed of multiple conductive strips extending in the horizontal direction. Each of the conductive strips of the feeding patch is arranged on a different layer of the multi-layer PCB. The conductive strips of the feeding patch are electrically connected to each other by conductive vias extending between two or more of the conductive strips of the feeding patch, which are arranged on different layers of the multi-layer PCB.

According to an embodiment, the conductive strips and the conductive vias of the antenna patch are arranged to form a mesh pattern. For example, the conductive strips and the conductive vias of the antenna patch may form a regular grid extending in a plane defined by the horizontal direction and the vertical direction.

Similarly, the conductive strips and the conductive vias of the feeding patch may be arranged to form a mesh pattern.

For example, the conductive strips and the conductive vias of the antenna patch may form a regular grid extending in a plane defined by the horizontal direction and the vertical direction, parallel to a plane in which the antenna patch extends.

In the vertical and the horizontal direction, the feeding patch may have a dimension which is shorter than a quarter wavelength of a radio signal to be transmitted via the antenna. For example, a vertical dimension of the antenna patch may be in the range of 0.2 mm to 8 mm. Similarly, a horizontal dimension of the antenna patch may be in the range of 0.2 mm to 8 mm.

According to an embodiment, the antenna further comprises a grounding patch which conductively connects the antenna patch to a groundplane. The groundplane may be formed by one or more conductive regions of one or more layers of the multi-layer PCB.

According to an embodiment, the grounding patch has a length which is shorter than a quarter wavelength of a radio signal to be transmitted via the antenna. For example, the length of the grounding patch may be in the range of 0.2 mm to 8 mm.

According to an embodiment, the antenna is configured for transmission of radio signals having a wavelength of more than 1 mm and less than 3 cm, corresponding to frequencies of the radio signals in the range of 10 GHz to 300 GHz.

According to a further embodiment, a device is provided. The device comprises at least one antenna according to any one of the above embodiments and the multi-layer PCB. Further, the device may comprise radio front end circuitry arranged on the multi-layer PCB. The radio front end circuitry may for example include one or more amplifiers and/or one or more modulators for processing radio signals transmitted via the antennas. The device may for example correspond to an antenna module including multiple antennas. Further, the device may correspond to an antenna circuit package including one or more antennas and radio front end circuitry for feeding radio frequency signals to the antenna (s).

According to an embodiment, the device comprises a first antenna according to any one of the above embodiments and a second antenna according to any one of the above embodiments, and the antenna patch of the first antenna has a different size than the antenna patch of the second antenna. In this way, the first antenna and the second antenna may efficiently support transmission of radio signals from two different frequency bands.

According to an embodiment, the feeding patch of the first antenna and the feeding patch of the second antenna are connected to a common feeding branch formed by a conductive strip on one of the layers of the multi-layer PCB.

According to an embodiment, the device further comprises at least one dipole antenna formed by conductive strips on one or more of the layers of the multi-layer printed circuit board, e.g., conductive strips extending along the horizontal direction.

According to an embodiment, the device comprises a first dipole antenna formed by conductive strips on one of the layers of the multi-layer PCB and a second dipole antenna formed by conductive strips on this one layer of the multi-layer PCB, and the conductive strips of the first dipole antenna have a different size than the conductive strips of the second dipole antenna. In this way, the first dipole antenna and the second dipole antenna may efficiently support transmission of radio signals from two different frequency bands.

According to an embodiment, the first dipole antenna and the second dipole antenna are connected to a common feeding branch formed by conductive strips on the one layer of the multi-layer PCB.

If the device includes radio front end circuitry arranged on the multi-layer PCB, the multi-layer PCB may comprise a cavity in which the radio front end circuitry is received.

According to a further embodiment, a communication device is provided, e.g., in the form of a mobile phone, smartphone or similar user device. The communication device comprises a device according to any one of the above embodiments, i.e., a device including at least one antenna according to any one of the above embodiments and the multi-layer PCB. Further, the communication device comprises at least one processor configured to process communication signals transmitted via the at least one antenna of the device.

The above and further embodiments of the invention will now be described in more detail with reference to the accompanying drawings.

DETAILED DESCRIPTION OF EMBODIMENTS

In the following, exemplary embodiments of the invention will be described in more detail. It has to be understood that the following description is given only for the purpose of illustrating the principles of the invention and is not to be taken in a limiting sense. Rather, the scope of the invention is defined only by the appended claims and is not intended to be limited by the exemplary embodiments described hereinafter.

The illustrated embodiments relate to antennas for transmission of radio signals, in particular of short wavelength radio signals in the cm/mm wavelength range. The illustrated antennas and antenna devices may for example be utilized in communication devices, such as a mobile phone, smartphone, tablet computer, or the like.

In the illustrated concepts, a multi-layer PCB is utilized for forming a C-fed (capacitively fed) patch antenna. The multi-layer PCB has multiple layers stacked in a vertical direction. The layers of the multi-layer PCB may be individually structured with patterns of conductive strips. In particular, conductive strips formed on different layers of the multi-layer PCB may be connected to each other by conductive vias extending between the conductive strips of different layers to form an antenna patch and a feeding patch which is capacitively coupled to the antenna patch. The patch antenna may be of a quarter-wave type or of a half-wave type. In this way, the antenna patch and the feeding patch may be formed to extend in the vertical direction, perpendicular to the planes of the layers of the multi-layer PCB. In this way, an antenna allowing for transmission of radio signals polarized in the vertical direction may be formed in an efficient manner. Further, one or more layers of the multi-layer PCB may be utilized in an efficient manner for connecting the patch antenna to radio front end circuitry. Specifically, a small size of the patch antenna and short lengths of connections to the patch antenna may be achieved. Further, it is possible to integrate a plurality of such patch antennas on the multi-layer PCB. Moreover, the patch antenna(s) can be efficiently combined with other antenna types formed on one or more layers of the multi-layer PCB. In this way, different polarization directions and/or different frequency bands may be supported in a compact structure.

Figure 1:
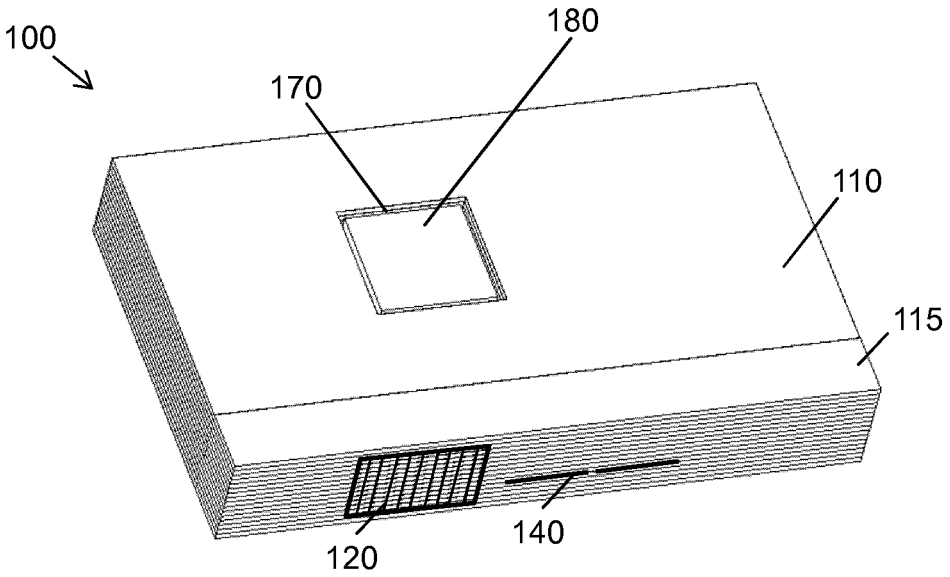
FIG. 1 shows a perspective view schematically illustrating an antenna device according to an embodiment of the invention.

FIG. 1 shows a perspective view illustrating an antenna device 100 which is based on the illustrated concepts. In the illustrated example, the antenna device 100 includes a multi-layer PCB 110 and antennas 120, 140 formed in an edge region of the multi-layer PCB 110. The multi-layer PCB 110 includes multiple PCB layers which are stacked in a vertical direction. The PCB layers may for example each correspond to a structured metallization layer on an isolating substrate. The antenna 120 is a patch antenna extending in a plane which is perpendicular to the PCB layers and parallel to one of the edges of the multi-layer PCB 110. The antenna 140 is a dipole antenna formed on one of the PCB layers and extends in a horizontal direction, perpendicular to the vertical direction and along the edge of the multi-layer PCB 110.

Further, the antenna device 100 includes a radio front end circuitry chip 180 which is arranged in a cavity 170 formed in the multi-layer PCB 110. Accordingly, electric connections from the radio front end circuitry chip 180 to the antennas 120, 140 can be efficiently formed by conductive strips on one or more of the PCB layers. In particular, the electric connections may be formed with short lengths, so that signal losses at high frequencies can be limited. Further, one or more of the PCB layers may also be utilized for connecting the radio front end circuitry chip 180 to other circuitry, e.g., to power supply circuitry or digital signal processing circuitry.

Figure 2:
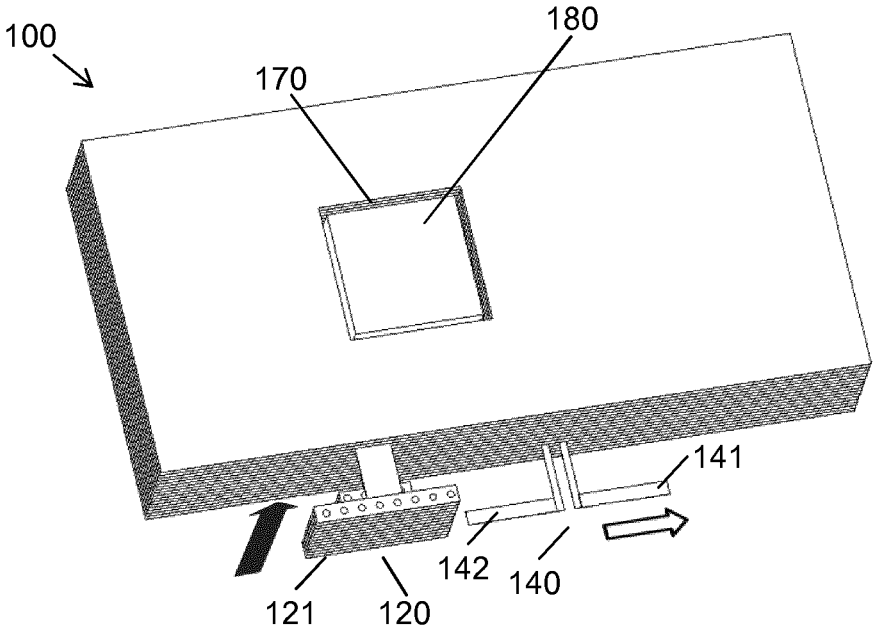
FIG. 2 shows a further perspective view for illustrating antennas of the antenna device.

FIG. 2 further illustrates structures of the patch antenna 120 and the dipole antenna 140. For this purpose, FIG. 2 does not show the isolating substrates of the PCB layers in the edge region 115 of the multi-layer PCB 110.

As can be seen, the patch antenna 120 includes an antenna patch 121 which extends in a plane which is perpendicular to the PCB layers and extends along the edge of the multi-layer PCB 110. The antenna patch 121 is configured for transmission of radio signals with a vertical polarization direction (illustrated by a solid arrow), i.e., a direction perpendicular to the PCB layers. The dipole antenna 140 includes a first pole formed of a first conductive strip 141 and a second pole formed of a second conductive strip 142. The first conductive strip 141 and the second conductive strip 142 extend along the edge of the multi-layer PCB 110.

The dipole antenna 140 is configured for transmission of radio signals with a horizontal polarization direction (illustrated by an open arrow), i.e., a direction parallel to the PCB layers and parallel to the edge of the multi-layer PCB 110.

Figure 3:
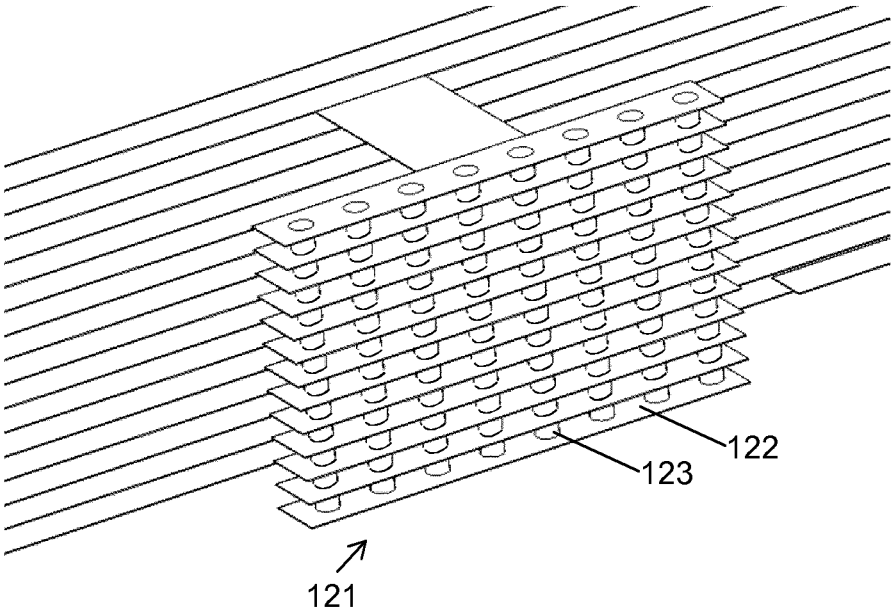
FIG. 3 shows a perspective view for schematically illustrating an antenna patch of the antenna device.

FIG. 3 further illustrates structures of the antenna patch 121. Similar to FIG. 2, FIG. 3 does not show the isolating substrates of the PCB layers in the edge region 115 of the multi-layer PCB 110.

As can be seen, the antenna patch 121 is formed of multiple conductive strips 121 on different PCB layers. The conductive strips 122 are stacked above each other in the vertical direction, thereby forming a three-dimensional superstructure. The conductive strips 122 of the different PCB layers are connected by conductive vias 123, e.g., metalized via holes. As illustrated, the conductive strips 122 and the conductive vias of the antenna patch 121 are arranged in a mesh pattern and form a substantially rectangular conductive structure extending the plane perpendicular to the PCB layers and in parallel to the edge of the multi-layer PCB 110. The grid spacing of the mesh pattern is selected to be sufficiently small so that, at the intended wavelength of the radio signals to be transmitted by the patch antenna 120, differences as compared to a uniform conductive structure are negligible. Typically, this can be achieved by a grid spacing of less than a quarter of the vertical and/or horizontal dimension of the antenna patch 121, e.g., of about 10% of the vertical and/or horizontal dimension of the antenna patch. It is noted that while FIG. 3 shows the mesh pattern with a regular grid structure, utilization of an irregular grid structure, e.g., based on irregular distances of the vias 123 along the conductive strip 122 and/or vias 123 which are not-aligned in the vertical direction, could be utilized as well.

Figure 4:
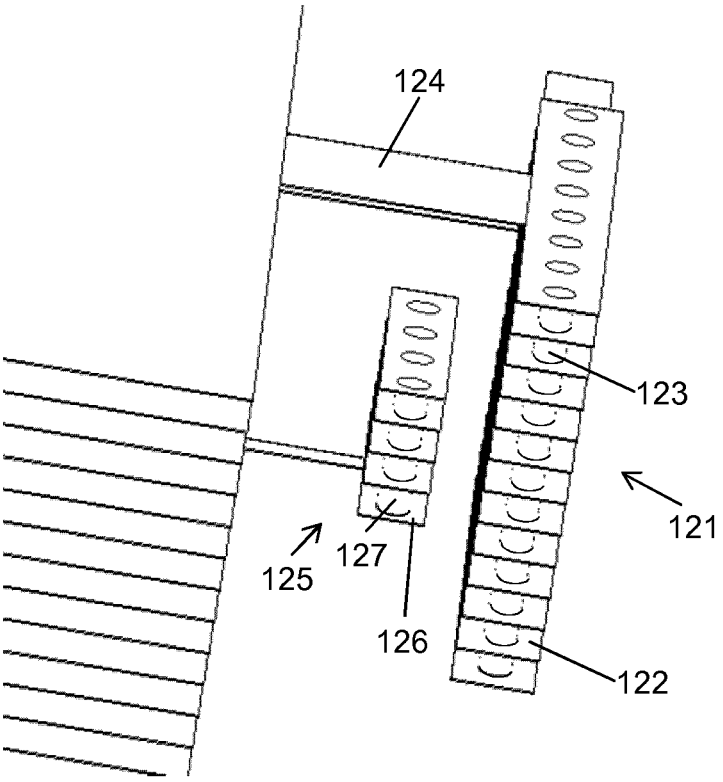
FIG. 4 shows a perspective view for schematically illustrating a feeding patch of the antenna device.

FIG. 4 further illustrates structures of the patch antenna 120. Similar to FIGS. 2 and 3, FIG. 4 does not show the isolating substrates of the PCB layers in the edge region 115 of the multi-layer PCB 110.

As can be seen, in addition to the antenna patch 121, the patch antenna 120 includes a feeding patch 125. The feeding patch 125 is configured for capacitive feeding of the antenna patch 121 and extends in parallel to the antenna patch 121, offset therefrom towards the center of the multi-layer PCB 110. The feeding patch 125 has a smaller size than the antenna patch 121. Similar to the antenna patch 121, the feeding patch 125 is formed of multiple conductive strips 126 on different PCB layers. The conductive strips 126 are stacked above each other in the vertical direction, thereby forming a three-dimensional superstructure. The conductive strips 126 of the different PCB layers are connected by conductive vias 127, e.g., metalized via holes. As illustrated, the conductive strips 126 and the conductive vias of the feeding patch 125 are arranged in a mesh pattern and form a substantially rectangular conductive structure extending the plane perpendicular to the PCB layers and in parallel to the edge of the multi-layer PCB 110. The grid spacing of the mesh pattern is selected to be sufficiently small so that, at the intended wavelength of the radio signals to be transmitted by the patch antenna 120, differences as compared to a uniform conductive structure are negligible. Accordingly, the feeding patch 125 may be formed with a similar or the same grid spacing as the antenna patch 121. Similar to the antenna patch 121, the feeding patch 125 may have a regular grid structure or an irregular grid structure.

As further illustrated in FIG. 4, the patch antenna 120 may be provided with a grounding patch 124 which electrically connects the antenna patch 121 to a groundplane. The groundplane could be formed by a conductive region on one of the PCB layers. The grounding patch 124 may be formed of a conductive strip formed on one of the PCB layers. As illustrated in FIG. 4, the grounding patch 124 may be offset from the feeding patch 125 in the vertical direction.

Figure 5:
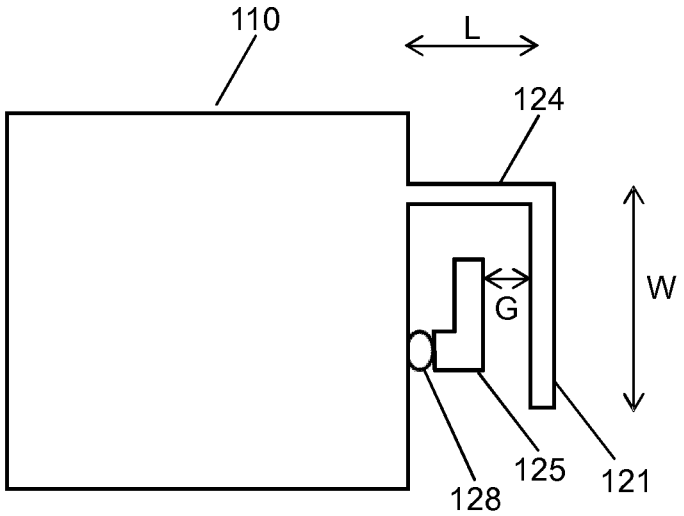
FIG. 5 shows a sectional view schematically illustrating configuration and dimensioning of a patch antenna of the antenna device.

FIG. 5 shows a schematic sectional view for illustrating configuration and dimensioning of the patch antenna 120, i.e., a view in a plane perpendicular to the horizontal direction. As can be seen, the feeding patch 125 is connected to a feeding point 128. From the feeding point 128, an electrical connection to the radio front end circuitry chip 180 may be formed on one of the PCB layers. The feeding patch 125 is spaced by a distance G from the antenna patch 121. The antenna patch has a dimension W along the horizontal direction, and the grounding patch 124 has a length L. The distance G and the size of the feeding patch 125 may be set with the aim of optimizing capacitive coupling to the antenna patch 121. Simulations have shown that a small sized feeding patch 125, e.g., having a quarter or less of the size of the antenna patch 121, allows for achieving a good bandwidth a compact overall size of the patch antenna 120, and an almost uniform omnidirectional transmission characteristic.

Further, the dimension W, the distance G, and the length L may be set according to the nominal wavelength of radio signals to be transmitted or received via the patch antenna 120. As a general rule, when assuming a configuration of the patch antenna 120 as a quarter wave patch antenna, the dimension W may correspond to a quarter of the nominal wavelength, and the length L and the distance G may be less than a quarter of the nominal wavelength. If the patch antenna is configured as a half wave patch antenna, the grounding patch 124 is omitted, the dimension W may correspond to half of the nominal wavelength, and the distance G may be less than a quarter of the nominal wavelength.

For example, when optimizing the patch antenna 120 for radio signals with a frequency of 14 GHz, W may be about 3 mm and the length L may be less than 3 mm, such as 2 mm. When optimizing the patch antenna 120 for radio signals with a frequency of 28 GHz, W may be about 1.5 mm and the length L may be less than 1.5 mm, such as 1 mm. Accordingly, the patch antenna 120 can be built without requiring excessive thickness of the multi-layer PCB 110. In particular, the thickness of the multi-layer PCB 110 may be 5 mm or even less.

Figure 6:
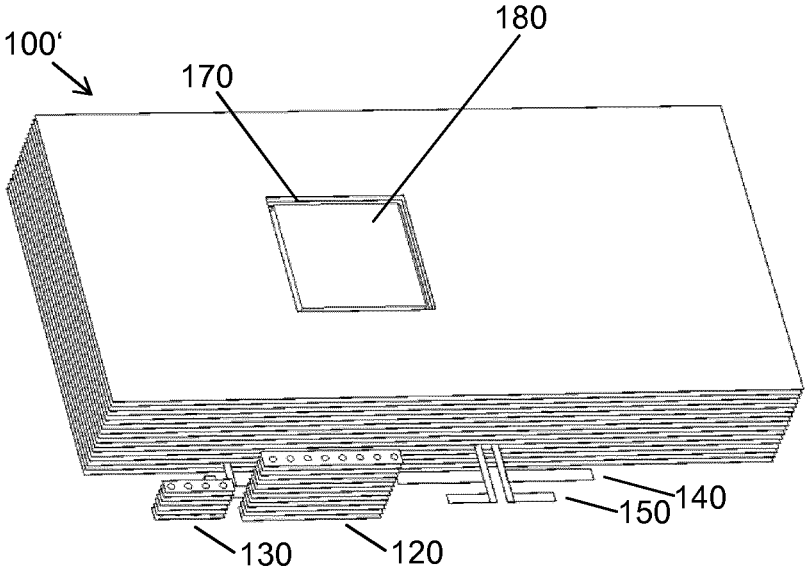
FIG. 6 shows a perspective view schematically illustrating an antenna device according to a further embodiment of the invention.

FIG. 6 shows a perspective view illustrating a further antenna device 100' which is based on the illustrated concepts. Structures which are similar to those of FIGS. 1 to 5 have been designated with the same reference signs, and details of such structures can also be taken from the above description in connection with FIGS. 1 to 5.

As illustrated, the antenna device 100' includes a multi-layer PCB 110 and antennas 120, 130, 140 150, formed in an edge region of the multi-layer PCB 110. The multi-layer PCB 110 includes multiple PCB layers which are stacked in a vertical direction. The PCB layers may for example each correspond to a structured metallization layer on an isolating substrate. For illustrative purposes, FIG. 6 does not show the isolating substrates of the PCB layers in the edge region 115 of the multi-layer PCB 110. Further, the antenna device 100' includes a radio front end circuitry chip 180 which is arranged in a cavity 170 formed in the multi-layer PCB 110. Accordingly, electric connections from the radio front end circuitry chip 180 to the antennas 120, 130, 140, 150 can be efficiently formed by conductive strips on one or more of the PCB layers.

The antennas 120 and 130 are patch antennas extending in a plane which is perpendicular to the PCB layers and parallel to one of the edges of the multi-layer PCB 110. The antennas 140, 150 are dipole antennas formed on one of the PCB layers and extend in a horizontal direction, perpendicular to the vertical direction and along the edge of the multi-layer PCB 110. As can be seen, the patch antennas 120 and 130 have different sizes to support transmission in different frequency bands. Similarly, the dipole antennas 140 and 150 have different sizes to support transmission in different frequency bands. As in the above example, the patch antennas 120, 130 are configured for transmission of radio signals with a vertical polarization direction, and the dipole antennas 140, are configured for transmission of radio signals with a horizontal polarization direction.

Figure 7:
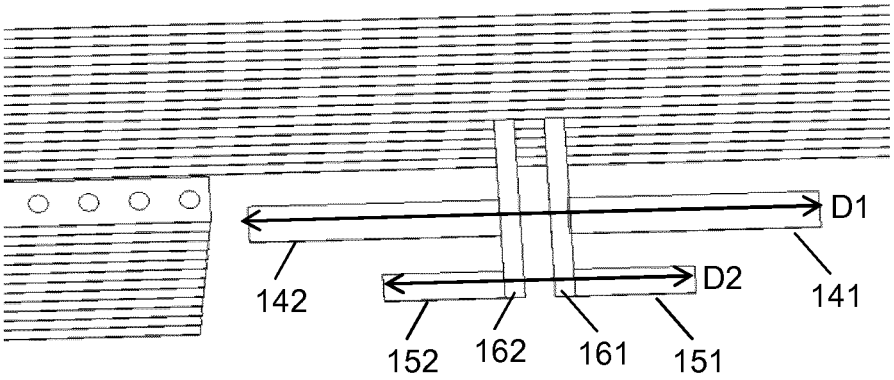
FIG. 7 shows a perspective view schematically illustrating dimensioning of different antennas of the antenna device.

FIG. 7 further illustrates the different dimensioning of the dipole antennas 140, 150. The dipole antenna 140 includes a first pole formed of a first conductive strip 141 and a second pole formed of a second conductive strip 142. The first conductive strip 141 and the second conductive strip 142 extend along the edge of the multi-layer PCB 110 and extend over a first length D1. The dipole antenna 140 includes a first pole formed of a first conductive strip 151 and a second pole formed of a second conductive strip 152. The first conductive strip 151 and the second conductive strip 152 extend along the edge of the multi-layer PCB 110 and extend over a second length D2. The first length D1 is higher than the second length D2, i.e., the first dipole antenna 140 is optimized for transmission of radio signals with a longer wavelength than the second dipole antenna 150. For example, the first length D1 may correspond to half of the nominal wavelength of radio signals in a first frequency band (e.g., in the range of 25 GHz), and the second length D2 may correspond to half of the nominal wavelength of radio signals in a first frequency band (e.g., in the range of 40 GHz).

As further shown in FIG. 7, the first dipole antenna 140 and the second dipole antenna 150 share a common feeding branch formed of conductive strips 161, 162. The conductive strip 161 is connected to the conductive strips 141 and 151, i.e., feeds the first poles of the dipole antennas 140, 150. The conductive strip 162 is connected to the conductive strips 142 and 152, i.e., feeds the second poles of the dipole antennas 140, 150.

Figure 8:
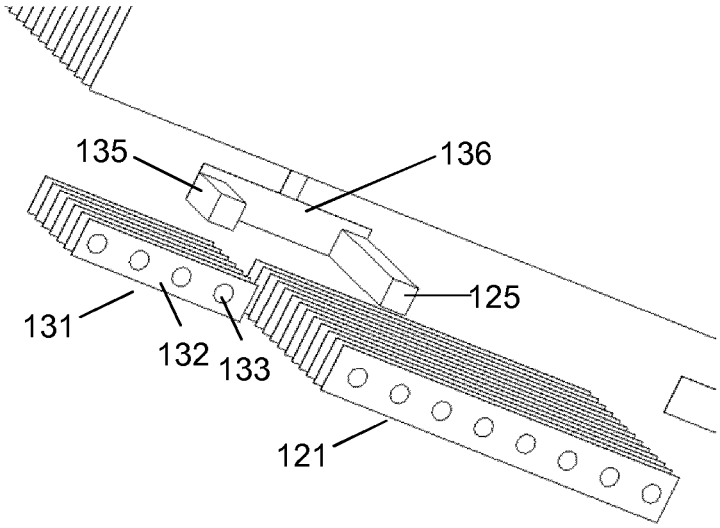
FIG. 8 shows a perspective view schematically illustrating capacitive feeding of different antennas of the antenna device.

FIG. 8 further illustrates structures of the patch antennas 120, 130. As can be seen, the first patch antenna 120 includes an antenna patch 121. As explained in connection with FIG. 3, the antenna patch 121 is formed of multiple conductive strips on different PCB layers which are connected to each other by conductive vias. Similarly, the second patch antenna 130 includes an antenna patch 131 formed of multiple conductive strips 132 on different PCB layers. The conductive strips 132 are stacked above each other in the vertical direction, thereby forming a three-dimensional superstructure. The conductive strips 132 of the different PCB layers are connected by conductive vias 133, e.g., metalized via holes. As illustrated, the conductive strips 132 and the conductive vias of the antenna patch 131 are arranged in a mesh pattern and form a substantially rectangular conductive structure extending the plane perpendicular to the PCB layers and in parallel to the edge of the multi-layer PCB 110. The antenna patch 131 may be formed with a similar or the same grid spacing as the antenna patch 121. Similar to the antenna patch 121, the antenna patch 131 may have a regular grid structure or an irregular grid structure.

As mentioned above, the first patch antenna 120 and the second patch antenna 130 have different sizes to support different wavelengths. For example, when designating the vertical dimension with W (as in the illustration of FIG. 5), the patch antenna 120 may have a higher vertical dimension than the patch antenna 130. For example, when assuming a configuration as half wave patch antennas, the vertical dimension W of the antenna patch 121 of the first patch antenna 120 may correspond to half of the nominal wavelength of radio signals in a first frequency band (e.g., in the range of 25 GHz), and the vertical dimension W of the antenna patch 131 of the second patch antenna 130 may correspond to half of the nominal wavelength of radio signals in a first frequency band (e.g., in the range of 40 GHz).

As further shown in FIG. 8, the patch antenna 120 and the second patch antenna 130 share a common feeding branch 136. The common feeding branch 136 is formed of a conductive strip on one of the PCB layers and connects to a first feeding patch 125 extending in the vertical direction and configured for capacitive feeding of the antenna patch 121. As explained in connection with FIG. 4, the feeding patch 125 may be formed of conductive strips on different PCB layers which are vertically connected by conductive vias. Further, the common feeding branch 136 connects to a second feeding patch 135 extending in the vertical direction and configured for capacitive feeding of the antenna patch 131. Similar to the first feeding patch 125, the second feeding patch 135 may be formed of conductive strips on different PCB layers which are vertically connected by conductive vias. In accordance with the differently sized antenna patches 121, 131, also the corresponding feeding patches 125, 135 may be configured with different sizes.

Figure 9:
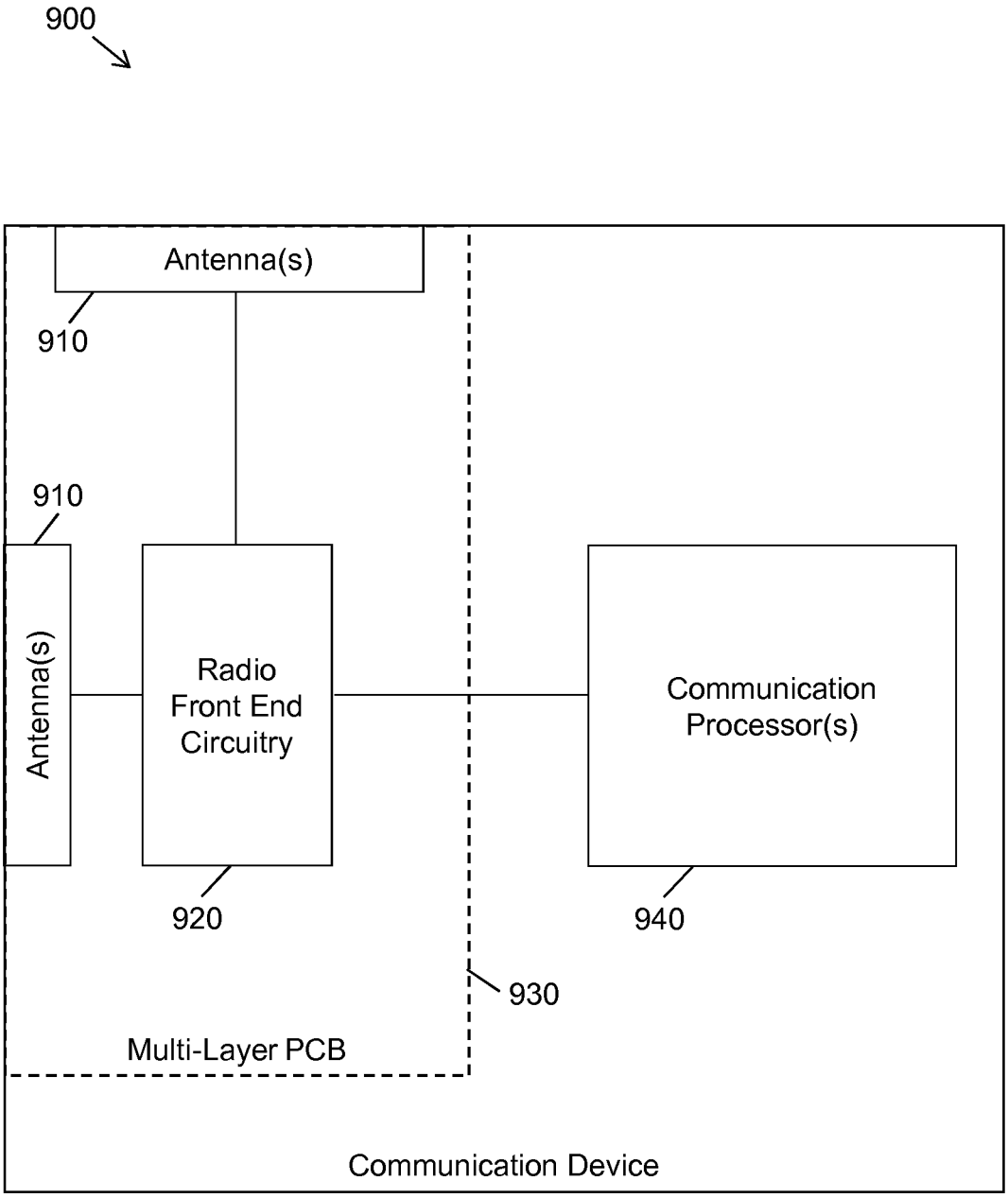
FIG. 9 shows a block diagram for schematically illustrating a communication device according to an embodiment of the invention.

FIG. 9 schematically illustrates a communication device 900 which is equipped with an antenna device as explained above, e.g., with the antenna device 100 or the antenna device 100'. The communication device may correspond to a small sized user device, e.g., a mobile phone, a smartphone, a tablet computer, or the like. However, it is to be understood that other kinds of communication devices could be used as well, e.g., vehicle based communication devices, wireless modems, or autonomous sensors.

As illustrated, the communication device 900 includes one or more antennas 910. These antennas 910 include at least one antenna of the above-mentioned patch antenna type, such as the patch antenna 120 or the patch antenna 130. Further, the communication device 900 may also include other kinds of antennas, such as the above-mentioned dipole antennas 140, 150, or even other antenna types. Using concepts as explained above, the antennas 910 are integrated together with radio front end circuitry 920 on a multi-layer PCB 930. As further illustrated, the communication device 900 also includes one or more communication processor(s) 940. The communication processor(s) 940 may generate or otherwise process communication signals for transmission via the antennas 910. For this purpose, the communication processor(s) 940 may perform various kinds of signal processing and data processing according to one or more communication protocols, e.g., in accordance with a 5G cellular radio technology.

It is to be understood that the concepts as explained above are susceptible to various modifications. For example, the concepts could be applied in connection with various kinds of radio technologies and communication devices, without limitation to a 5G technology. The illustrated antennas may be used for transmitting radio signals from a communication device and/or for receiving radio signals in a communication device. Further, it is to be understood that the illustrated antenna structures may be subjected to various modifications concerning antenna geometry. For example, the illustrated rectangular antenna patch shapes could be modified to more complex shapes.

The invention claimed is:

1. An antenna, comprising an antenna patch;

a grounding patch that conductively connects the antenna patch to a groundplane formed by a conductive region on one layer of a multi-layer printed circuit board having multiple layers stacked along a vertical direction; and a feeding patch configured for capacitive feeding of the antenna patch, the antenna patch being formed of multiple conductive strips extending in a horizontal direction along an edge of the multi-layer printed circuit board, each of the conductive strips of the antenna patch being arranged on a different layer of the multi-layer printed circuit board, the conductive strips being electrically connected to each other by conductive vias extending between two or more of the conductive strips of the antenna patch, which are arranged on different layers of the multi-layer printed circuit board, the feeding patch being formed of multiple conductive strips extending in the horizontal direction, each of the conductive strips of the feeding patch being arranged on a different layer of the multi-layer printed circuit board, and the conductive strips of the feeding patch being electrically connected to each other by conductive vias extending between two or more of the conductive strips of the feeding patch, which are arranged on different layers of the multi-layer printed circuit board.

2. The antenna according to claim 1, wherein the conductive strips and the conductive vias of the antenna patch are arranged to form a mesh pattern.

3. The antenna according to claim 1, wherein the conductive strips and the conductive vias of the feeding patch are arranged to form a mesh pattern.

4. The antenna according to claim 1, wherein, in the vertical and the horizontal direction, the feeding patch has a dimension which is shorter than a quarter wavelength of a radio signal to be transmitted via the antenna.

5. The antenna according to claim 1, further comprising:

a grounding patch which conductively connects the antenna patch to a groundplane.

6. The antenna according to claim 5, wherein the grounding patch has a length which is shorter than a quarter wavelength of a radio signal to be transmitted via the antenna.

7. The antenna according to claim 1, wherein the antenna is configured for transmission of radio signals having a wavelength of more than 1 mm and less than 3 cm.

8. A device, comprising, at least one antenna according to claim 1; and the multi-layer printed circuit board.

9. The device according to claim 8, comprising:

a first antenna according to claim 1, and a second antenna according to claim 1;

wherein the antenna patch of the first antenna has a different size than the antenna patch of the second antenna.

10. The device according to claim 9, wherein the feeding patch of the first antenna and the feeding patch of the second antenna are connected to a common feeding branch formed by a conductive strip on one of the layers of the multi-layer printed circuit board.

11. The device according to claim 8, comprising:

at least one dipole antenna formed by conductive strips on one or more of the layers of the multi-layer printed circuit board.

12. The device according to claim 11, comprising:

a first dipole antenna formed by conductive strips on one of the layers of the multi-layer printed circuit board, and a second dipole antenna formed by conductive strips on said one layer of the multi-layer printed circuit board;

wherein the conductive strips of the first dipole antenna have a different size than the conductive strips of the second dipole antenna.

13. The device according to claim 12, wherein the first dipole antenna and the second dipole antenna are connected to a common feeding branch formed by conductive strips on said one layer of the multi-layer printed circuit board.

14. The device according to claim 8, comprising:

radio front end circuitry arranged on the multi-layer printed circuit board.

15. The device according to claim 14, wherein the multi-layer printed circuit board comprises a cavity in which the radio front end circuitry is received.

16. A communication device, comprising:

a device according to claim 7; and at least one processor configured to process communication signals transmitted via the at least one antenna of the device.

17. The antenna of claim 1, wherein the grounding patch is offset from the feeding patch in the vertical direction.

* * * * *